US012564266B1

(12) United States Patent
Jiang et al.

(10) Patent No.: US 12,564,266 B1
(45) Date of Patent: Mar. 3, 2026

(54) SEX POSITIONING CHAIR

(71) Applicant: Dongguan Mizhilian Technology Co., Ltd., Dongguan (CN)

(72) Inventors: Junhua Jiang, Dongguan (CN); Xinlong Tang, Dongguan (CN)

(73) Assignee: Dongguan Mizhilian Technology Co., Ltd., Dongguan (CN)

( * ) Notice: Subject to any disclaimer, the term of this patent is extended or adjusted under 35 U.S.C. 154(b) by 0 days.

(21) Appl. No.: 19/209,807

(22) Filed: May 16, 2025

(30) Foreign Application Priority Data

Mar. 18, 2025 (CN) ..... 202520484490.0

(51) Int. Cl.
*A47C 15/00* (2006.01)
*A47B 91/02* (2006.01)

(52) U.S. Cl.
CPC ..... *A47C 15/008* (2013.01); *A47B 91/022* (2013.01)

(58) Field of Classification Search
CPC ..... A61G 7/07; A61G 13/12; A61G 13/121; A61G 13/122; A61G 13/1225; A61H 1/0292; A61H 1/0218; A61H 1/0222; A61H 1/02; A61H 1/0229; A61H 1/005; A47C 15/004; A47C 15/008; A47C 16/04; A47C 16/005; A47C 20/02; A47C 20/026; A47C 20/04; A47C 20/043; A47C 7/38; A47C 7/383; A47C 7/68; A47C 4/52; A47B 39/00; A47D 1/008–0085; A47D 3/001; Y10S 5/929
USPC ..... 128/845
See application file for complete search history.

(56) References Cited

U.S. PATENT DOCUMENTS 3,413,664 A * 12/1968 Ernest ..... A61G 7/07 5/632
3,905,051 A * 9/1975 Gozdziewski ..... A47C 15/004 4/240
4,901,385 A * 2/1990 Adolphson ..... A61G 7/0755 297/423.46
5,875,779 A * 3/1999 Fuhrman ..... A47C 15/008 600/38
6,139,567 A * 10/2000 McCarty ..... A47C 20/043 5/633
10,492,617 B1 * 12/2019 Macedo ..... A47C 20/02
2004/0212240 A1 * 10/2004 Zwezdaryk ..... A47C 15/008 297/440.1
2008/0122270 A1 * 5/2008 Dubiel ..... A47D 1/0085 297/173

(Continued)

*Primary Examiner* — Adam Baker
(74) *Attorney, Agent, or Firm* — Jose Cherson Weissbrot

(57) ABSTRACT

A posture-adjustable chair, relating to the technical field of adult products, includes a frame body placed on the ground in a vertical direction and defining a receiving space, an inclined plate located in the receiving space, a first support located below the inclined plate, and a second support located above the inclined plate. The inclined plate, the first support and the second support are all connected to the frame body, the second support is used for opening or closing the receiving space, and a preset angle formed by the inclined plate with respect to the vertical direction is $\alpha$, and $0° \leq \alpha \leq 50°$ is satisfied. With the assistance of the posture-adjustable chair provided in the application, a specific posture different from the conventional posture can be formed, so that the quality of sexual life of both men and women can be improved, and the pregnancy of women can be more facilitated.

10 Claims, 3 Drawing Sheets

(56) References Cited

U.S. PATENT DOCUMENTS

2020/0405565 A1* 12/2020 Neuman ..... A61H 1/0218

* cited by examiner

SEX POSITIONING CHAIR

TECHNICAL FIELD

The application relates to the technical field of adult products, and more particularly to a sex positioning chair.

BACKGROUND ART

The information disclosed in this Background section is intended solely to enhance understanding of the general background of the present disclosure and should not be taken as an acknowledgment or any form of suggestion that this information constitutes prior art known to a person skilled in the field.

With the development of social economy, people's material life has become increasingly affluent, and the demands for spiritual life have correspondingly risen. Particularly regarding marital life, improving sexual quality contributes significantly to family happiness and harmony. How to enhance the sexual quality for both partners remains a technical problem urgently needing resolution in this field.

SUMMARY OF THE INVENTION

In view of the above, an objective of the application is to provide a sex positioning chair, which aims to solve the technical problem of how to improve the quality of sexual life of both men and women.

In order to achieve the above-mentioned objective, the technical solution adopted by the application is as follows:

An embodiment of the application provides a sex positioning chair including:

- a frame body for being placed on the ground in a vertical direction, the frame body defining a receiving space;
- an inclined plate located in the receiving space and connected to the frame body, wherein a preset angle formed by the inclined plate with respect to the vertical direction is $\alpha$, and $0° \leq \alpha \leq 50°$ is satisfied;
- a first support located below the inclined plate in the vertical direction and connected to the frame body; and
- a second support located above the inclined plate in the vertical direction and connected to the frame body, the second support being used for opening or closing the receiving space.

In one embodiment, $30° \leq \alpha \leq 50°$ is satisfied.

In one embodiment, one side of the inclined plate is rotatably connected to the frame body, and a pin hole communicating with the receiving space is provided on the other side of the inclined plate, the sex positioning chair further including an adjustment pin, and a plurality of adjustment holes are provided on the frame body at intervals, each of the adjustment holes communicating with the receiving space, and the adjustment pin is provided through the pin hole and one of the adjustment holes.

In one embodiment, the frame body includes first mounting plate and the second mounting plate provided at intervals, the inclined plate is connected between the first mounting plate and the second mounting plate, the first support is connected between the first mounting plate and the second mounting plate, the second support includes a first support plate and a second support plate, the first support plate is movably connected to the first mounting plate, and the second support plate is movably connected to the second mounting plate.

In one embodiment, one side of the first support plate is rotatably connected to the first mounting plate, and one side of the second support plate is rotatably connected to the second mounting plate.

In one embodiment, the sex positioning chair further includes a first rotating hinge and a second rotating hinge, wherein one side of the first rotating hinge is connected to one side of the first mounting plate facing away from the second mounting plate, the other side of the first rotating hinge is connected to one side of the first support plate facing away from the first mounting plate, one side of the second rotating hinge is connected to one side of the second mounting plate facing away from the first mounting plate, and the other side of the second rotating hinge is connected to one side of the second support plate facing away from the second mounting plate:

when the second support closes the receiving space, one side of the first support plate facing the first mounting plate comes into contact with the first mounting plate, and one side of the second support plate facing the second mounting plate comes into contact with the second mounting plate.

In one embodiment, the frame body further includes a third mounting plate connected between the first mounting plate and the second mounting plate, the first mounting plate, the second mounting plate, and the third mounting plate collectively defining the receiving space.

In one embodiment, the sex positioning chair further includes a height adjusting member connected to a bottom portion of the frame body in the vertical direction for adjusting a distance between the frame body and the ground.

In one embodiment, the height adjusting member includes a plurality of leveling feet, adjacent two of the leveling feet are provided at intervals, and each of the leveling feet is screw-coupled to the frame body.

In one embodiment, the sex positioning chair further includes a third support connected to the frame body on one side of the inclined plate away from the first support.

Advantageous effects of the application are as follows:

the application provides a sex positioning chair including a frame body, an inclined plate, a first support and a second support, wherein the frame body is used for being placed on the ground in a vertical direction, and the frame body defines a receiving space, the inclined plate is located in the receiving space and is connected to the frame body, a preset angle formed by the inclined plate with respect to the vertical direction is in a range from 0° to 50°, the first support is located below the inclined plate in the vertical direction and is connected to the frame body, the second support is located above the inclined plate in the vertical direction and is connected to the frame body, and the second support is used for opening or closing the receiving space.

Based on the above-mentioned structure, when using the sex positioning chair provided in the application, the frame body is abutted against the edge of the bed, the receiving space is opened by the second support, the legs of the woman are laid on the bed, the upper part of the hip enters the receiving space and is laid down along the inclined plate, and the arms are supported on the first support, so that the upper part of the hip of the woman is kept at the above-mentioned preset angle with the vertical direction, i.e., at any value from 0° to 50°, the man is laid horizontally on the woman along the posture of the woman, and the upper part of the hip of the man is laid on the second support. The above-mentioned specific posture formed with the assistance of the sex positioning chair provided in the application can effectively improve the quality of sexual life of both men and women, and the pregnancy of women can be more facilitated.

To make the above-mentioned objectives, features and advantages of the application more comprehensible, preferred embodiments are specifically cited below and described in detail with reference to the accompanying drawings as follows.

BRIEF DESCRIPTION OF THE DRAWINGS

To provide a clearer illustration of the technical solutions in the embodiments of the application, a brief introduction will be given below regarding the accompanying drawings required for the embodiments. It should be understood that the following drawings only show some embodiments of the application and therefore should not be construed as limiting the scope. For a person skilled in the art, other related drawings may be derived from these accompanying drawings without creative effort.

Figure 1:
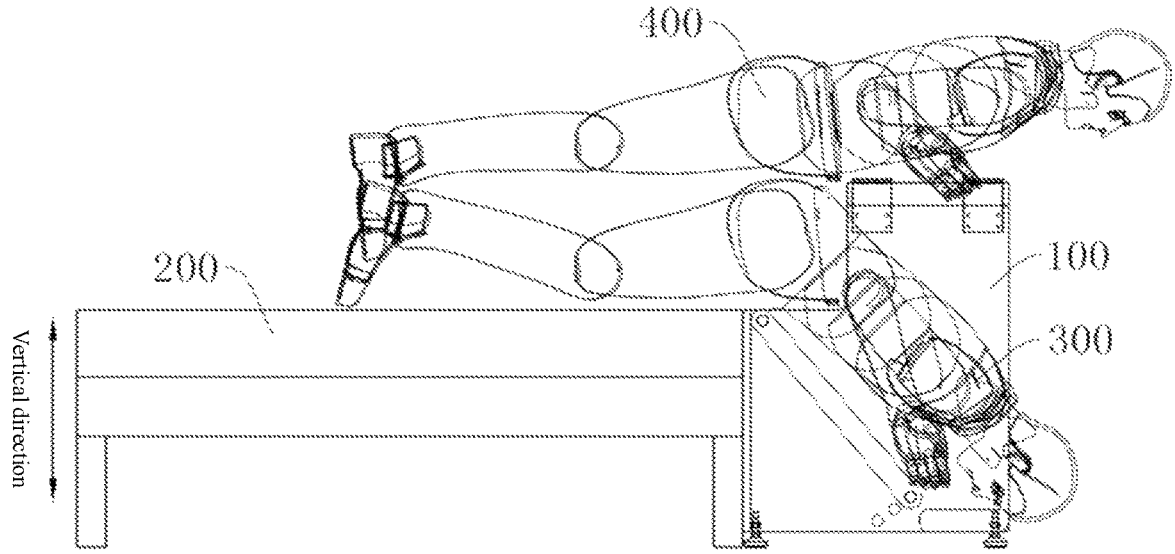
FIG. 1 shows a schematic diagram of a bed and a sex positioning chair used by men and women according to one embodiment of the application.

Explanation of main element symbols:

100—sex positioning chair; 110—frame body; 111—first mounting plate; 112—second mounting plate; 113—third mounting plate; 114—receiving space; 115—adjustment hole; 120—inclined plate; 121—pin hole; 130—first support; 140—second support; 141—first support plate; 142—second support plate; 161—adjustment pin; 162—first rotating hinge; 163—second rotating hinge; 170—height adjusting member; 171—leveling feet; 200—bed; 300—woman; 400—man.

DETAILED DESCRIPTION OF THE INVENTION

The embodiments of the application are described in detail below, with examples of the embodiments illustrated in the accompanying drawings, wherein the same or similar reference numerals throughout denote the same or similar elements or elements having the same or similar functions. The embodiments described below with reference to the accompanying drawings are exemplary and are intended to explain the application, but should not be construed as limiting the application.

In the description of the application, the orientation or positional relationship indicated by terms such as "center", "longitudinal", "transverse", "length", "width", "height", "upper", "lower", "front", "rear", "left", "right", "vertical", "horizontal", "top", "bottom", "inner", "outer", "clockwise", "counterclockwise", "axial", "radial", "circumferential", etc., is based on the orientation or positional relationship shown in the accompanying drawings, and is only for the purpose of facilitating the description of the application and simplifying the description, rather than indicating or implying that the device or element referred to must have a specific orientation or be constructed and operated in a specific orientation, and thus should not be construed as limiting the application.

Furthermore, unless otherwise expressly specified and defined, a first feature being "on" or "under" a second feature may mean that the first feature is in direct contact with the second feature, or that the first feature is in indirect contact with the second feature via an intermediate medium. Moreover, a first feature being "over", "above", or "on top of" a second feature may mean that the first feature is directly above or obliquely above the second feature, or may simply indicate that the horizontal level of the first feature is higher than that of the second feature. A first feature being "under", "below", or "beneath" a second feature may mean that the first feature is directly below or obliquely below the second feature, or may simply indicate that the horizontal level of the first feature is lower than that of the second feature.

In the description of the application, terms such as "first", "second", and the like are used to distinguish different objects, and are not to be construed as indicating or implying a specific order or hierarchical relationship, or as implicitly specifying the quantity of the indicated technical features. Thus, a feature defined as "first" or "second" may explicitly or implicitly includes one or more of the stated features. In the description of the application, "a plurality of" refers to two or more unless specifically defined otherwise.

In the description of the application, unless otherwise expressly specified and defined, the terms "mounted", "connected", "coupled", "fixed" and similar terms shall be interpreted broadly. For example, the connection may be a permanent connection or a detachable connection: it may be an integral connection: it may be a mechanical connection or an electrical connection: it may be a direct connection or an indirect connection through an intermediary medium; and it may refer to an internal communication between two components or an interactive relationship between two components. For a person skilled in the art, the specific meaning of the above terms in the application may be appreciated according to specific situations.

In the description of the application, the term "and/or" indicates that three relationships may exist. For instance, "A and/or B" may represent; the presence of A alone, the simultaneous presence of both A and B, or the presence of B alone. Furthermore, the character "/" generally denotes an "or" relationship between the associated preceding and succeeding elements.

In the description of the application, the term "parallel" encompasses not only situations of absolute parallelism but also circumstances of substantial parallelism as commonly understood in engineering practice. Similarly, the term "perpendicular" includes not only situations of absolute perpendicularity but also circumstances of substantial perpendicularity as routinely recognized in engineering applications. Illustratively, when the included angle between two directions falls within the range of 80° to 90°, the two directions may be considered perpendicular: when the included angle between two directions falls within the range of 0° to 10°, the two directions may be considered parallel.

With the development of social economy, people's material life has become increasingly affluent, and the demands for spiritual life have correspondingly risen. Particularly regarding marital life, improving sexual quality contributes significantly to family happiness and harmony. Current adult products such as position cushions or conception pillows merely provide auxiliary support for traditional sexual positions. In essence, they remain conventional positioning aids that fail to fundamentally enhance sexual satisfaction for both partners or improve woman conception probability. How to improve the quality of sexual life of both men and women and the pregnancy probability of women is a technical problem to be solved urgently in the art.

Figure 2:
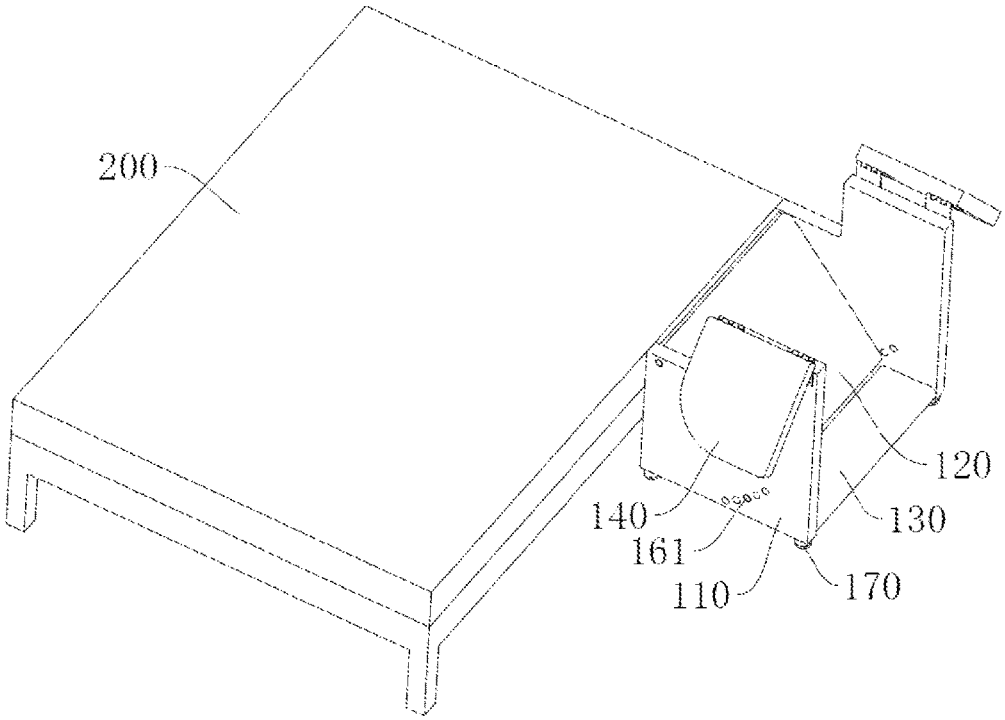
FIG. 2 shows a schematic diagram of a sex positioning chair against an edge of a bed according to one embodiment of the application.
Figure 4:
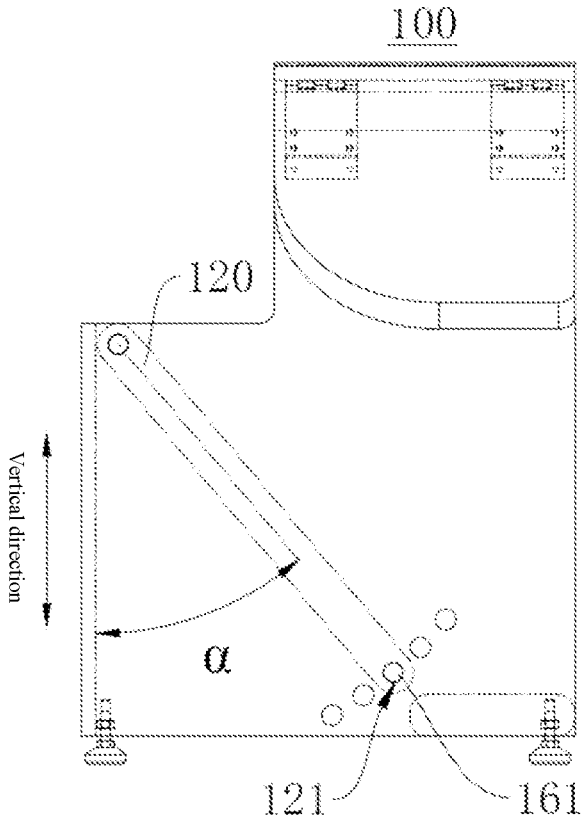
FIG. 4 shows a perspective schematic structural diagram of a sex positioning chair when a second support is opened according to one embodiment of the application.

In order to solve the above-mentioned technical problem, as shown in FIGS. 1, 2 and 4, one embodiment of the application provides a sex positioning chair 100, including: a frame body 110, an inclined plate 120, a first support 130 and a second support 140.

The frame body 110 is used for being placed on the ground in a vertical direction, and the frame body 110 defines a receiving space 114; the inclined plate 120 is located in the receiving space 114 and is connected to the frame body 110, and a preset angle formed by the inclined plate 120 with respect to the vertical direction is $\alpha$, and $0° \leq \alpha \leq 50°$ is satisfied; the first support 130 is located below the inclined plate 120 in the vertical direction and is connected to the frame body 110; the second support 140 is located above the inclined plate 120 in the vertical direction and is connected to the frame body 110, and is used for opening or closing the receiving space 114.

Illustratively, the preset angle $\alpha$ may be selected from any one of 0°, 2°, 5°, 8°, 10°, 15°, 19°, 20°, 25°, 30°, 35°, 40°, 45°, 50°, or any one of a range consisting of any two thereof, which is not particularly limited herein.

It can be understood that in using the sex positioning chair 100 provided in the present embodiment, illustratively, the frame body 110 is abutted against the edge of the bed 200, the receiving space 114 is opened by the second support 140, the legs of the woman 300 are laid on the bed 200, the upper part of the hip enters the receiving space 114 and is laid down along the inclined plate 120, and the arms are supported on the first support 130, so that the upper part of the hip of the woman 300 is maintained at the above-mentioned preset angle with the vertical direction, i.e., at any value from 0° to 50°, the man 400 is horizontally laid on the woman 300 along the posture of the woman 300, and the upper part of the hip of the man is laid on the second support 140. The above-described specific posture formed with the assistance of the sex positioning chair 100 provided in the present embodiment can effectively improve the quality of sexual life of both men and women, and the pregnancy of women 300 can be more facilitated.

Specifically, the aforementioned specific position can effectively improve the quality of sexual life and facilitate the pregnancy of women 300, mainly because; the upper body portion (above the hips) of the woman 300 maintains an angle of 0° to 50° relative to the vertical direction, with the vaginal orifice naturally facing upward, which allows the woman 300's vagina to assume a naturally tightened and narrowed state under gravitational forces from surrounding tissues, that is, the woman 300's vagina becomes more snug and constricted. Simultaneously, the G-spot of the vagina is precisely positioned to align with the man 400's top-down insertion trajectory, thereby receiving more direct stimulation. Furthermore, the man 400's top-down movement achieves deeper penetration and fuller contact, with the ejaculation position being closer to the cervical os.

It should be noted that the above-mentioned manner of abutting the frame body 110 against the edge of the bed 200 is merely an exemplary use scenario, i.e., a scenario in which the sex positioning chair 100 is used in cooperation with the bed 200, and according to different user preferences, the frame body 110 may also be used against other soft furniture, such as a sofa, a reclining chair, etc. and the use scenario of the sex positioning chair 100 is not particularly limited here: furthermore, the second support 140 serves not only to support the above-hip portion of the man 400, but also to open or close the receiving space 114, so that the above-hip portion of the woman 300 better enters the receiving space 114 and falls down along the inclined plate 120.

In one embodiment, $30° \leq \alpha \leq 50°$ is satisfied.

It can be understood that the quality of sexual life of both the man and woman can be further improved by controlling the preset angle $\alpha$ within a range from 30° to 50°.

Figure 3:
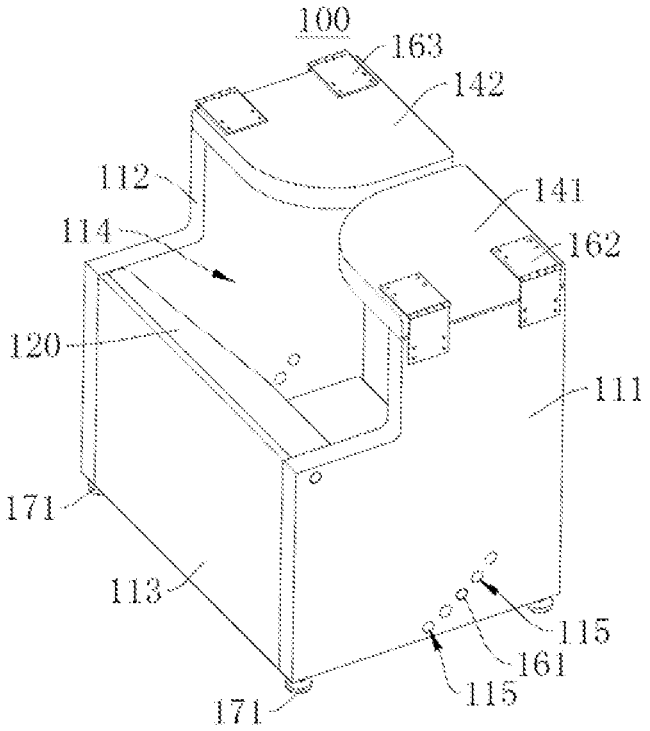
FIG. 3 shows a first perspective schematic structural diagram of a sex positioning chair when a second support is closed according to one embodiment of the application.

As shown in FIGS. 3 and 4, in one embodiment, one side of the inclined plate 120 is rotatably connected to the frame body 110, the other side of the inclined plate 120 is provided with a pin hole 121 in communication with the receiving space 114, the sex positioning chair 100 further includes an adjustment pin 161, the frame body 110 is provided with a plurality of adjustment holes 115 provided at intervals, each adjustment hole 115 is in communication with the receiving space 114, and the adjustment pin 161 is provided through the pin hole 121 and one of the adjustment holes 115.

Illustratively, the number of adjustment holes 115 may be two, three, four, five, six, etc., which is not particularly limited herein.

It can be understood that since the preset angle $\alpha$ is slightly different for different women, the angle adjustment function of the inclined plate 120 can be achieved by inserting the adjustment pin 161 into the different adjustment holes 115 when the sex positioning chair 100 is used, so as to meet the use requirements of different users.

Illustratively, $30° \leq \alpha \leq 500$ is satisfied and the number of the adjustment holes 115 is five, and the interval angle between two adjacent adjustment holes 115 is 5°, thereby achieving the adjustment of the inclined plate 120 in a range from 30° to 50° with a minimum adjustment unit of 5°.

As shown in FIGS. 2 and 3, in one embodiment, the frame body 110 includes a first mounting plate 111 and a second mounting plate 112 that are placed at intervals, the inclined plate 120 is connected between the first mounting plate 111 and the second mounting plate 112, the first support 130 is connected between the first mounting plate 111 and the second mounting plate 112, and the second support 140 includes a first support plate 141 movably connected to the first mounting plate 111 and a second support plate 142 movably connected to the second mounting plate 112.

It can be understood that the mounting of the first support 130, the first support plate 141, and the second support plate 142 is facilitated by the provision of the first mounting plate 111 and the second mounting plate 112. Furthermore, the first support plate 141 is movably connected to the first mounting plate 111, and the second support plate 142 is movably connected to the second mounting plate 112, so that the opening and closing of the receiving space 114 is facilitated, thereby facilitating the upper part of the hip of the woman 300 to better enter the receiving space 114 and to lie down along the inclined plate 120.

Figure 5:
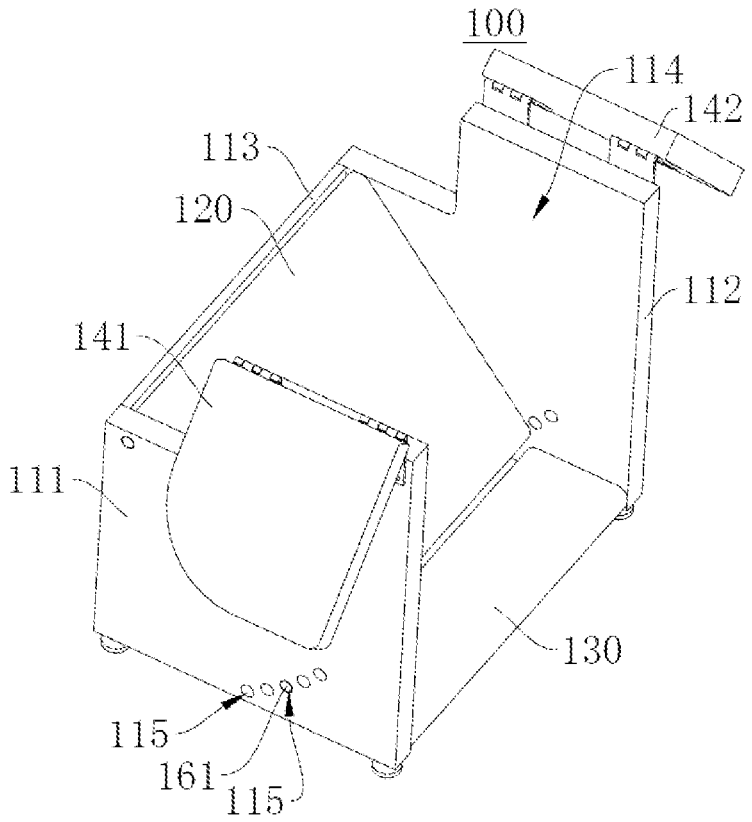
FIG. 5 shows a second perspective schematic structural diagram of a sex positioning chair when a second support is opened according to one embodiment of the application.

As shown in FIGS. 3 and 5, further, one side of the first support plate 141 is rotatably coupled to the first mounting plate 111, and one side of the second support plate 142 is rotatably coupled to the second mounting plate 112.

It can be understood that when the first support plate 141 and the second support plate 142 are rotated away from each other, opening of the receiving space 114 can be achieved so that the upper part of the hip of the woman 300 can better enter the receiving space 114 and lie down along the inclined plate 120. When the first support plate 141 and the second support plate 142 are rotated toward each other, it is possible to close the receiving space 114 and to support the upper part of the hip of the man 400 so that the man 400 is horizontally laid on the woman 300.

Of course, in the above-described embodiment, the first support plate 141 may be slidably connected to the first mounting plate 111, and the second support plate 142 may be slidably connected to the second mounting plate 112. In this way, when the first support plate 141 and the second support plate 142 slide away from each other, opening of the receiving space 114 can be achieved so that the upper part of the hip of the woman 300 can better enter the receiving space 114 and lie down along the inclined plate 120. When the first support plate 141 and the second support plate 142 slide toward each other, it is possible to close the receiving space 114 and to support the upper part of the hip of the man 400 so that the man 400 is horizontally laid on the woman 300.

Figure 6:
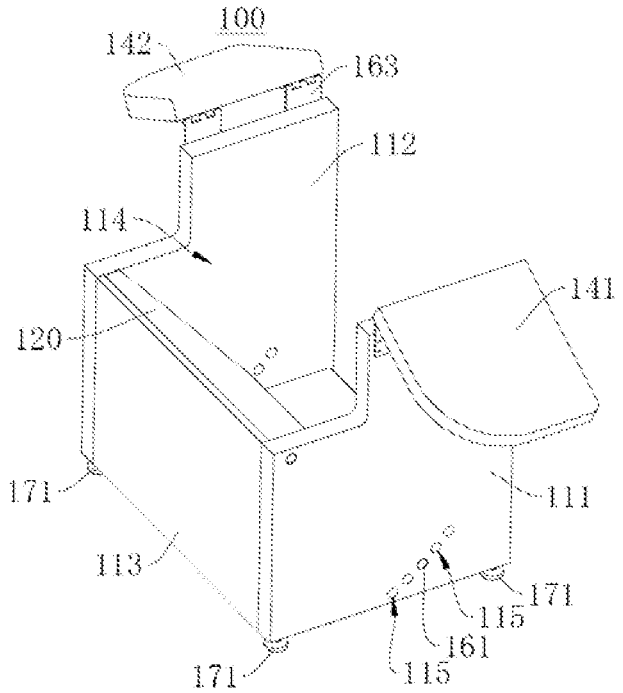
FIG. 6 shows a third perspective schematic structural diagram of a when a second support is opened according to one embodiment of the application.

As shown in FIGS. 3 and 6, the sex positioning chair 100 further includes a first rotating hinge 162 and a second rotating hinge 163, wherein one side of the first rotating hinge 162 is connected to one side of the first mounting plate 111 facing away from the second mounting plate 112, the other side of the first rotating hinge 162 is connected to one side of the first support plate 141 facing away from the first mounting plate 111, and one side of the second rotating hinge 163 is connected to one side of the second mounting plate 112 facing away from the first mounting plate 111, the other side of the second rotating hinge 163 is connected to the side of the second support plate 142 facing away from the second mounting plate 112, thereby achieving that the first support plate 141 and the second support plate 142 are rotatably connected to the frame body 110 via the first rotating hinge 162 and the second rotating hinge 163: meanwhile, when the second support 140 closes the receiving space 114, one side of the first support plate 141 facing the first mounting plate 111 abuts against the first mounting plate 111, and one side of the second support plate 142 facing the second mounting plate 112 abuts against the second mounting plate 112, thereby achieving that the first support plate 141 and the second support plate 142 are stabilized in a horizontal position so as to support the above-hip portion of the man 400.

Of course, for the above-mentioned embodiment, the first support plate 141 and the second support plate 142 may be rotatably connected to the frame body 110 via the first rotating shaft and the second rotating shaft, specifically, the first support plate 141 is rotatably connected to the first mounting plate 111 via the first rotating shaft, and the second support plate 142 is rotatably connected to the second mounting plate 112 via the second rotating shaft.

As shown in FIGS. 2 and 3, further, the frame body 110 further includes a third mounting plate 113 connected between the first mounting plate 111 and the second mounting plate 112, and the first mounting plate 111, the second mounting plate 112, and the third mounting plate 113 collectively define a receiving space 114.

It can be understood that by the first mounting plate 111, the second mounting plate 112, and the third mounting plate 113 are capable of enclosing and forming the receiving space 114, when the upper part of the hip of the woman 300 is laid down along the inclined plate 120 and the second support 140 closes the receiving space 114, the woman 300 is shielded by the frame body 110, and the experience of both the man and the woman can be increased.

As shown in FIG. 2, in one embodiment, the sex positioning chair 100 further includes a height adjusting member 170 connected to the bottom of the frame body 110 in the vertical direction for adjusting the distance between the frame body 110 and the ground so as to adjust the height of the sex positioning chair 100 according to the height of soft furniture such as a bed 200, a sofa, etc., thereby adapting the sex positioning chair 100 to the soft furniture.

As shown in FIGS. 2 and 3, further, the height adjusting member 170 includes a plurality of leveling feet 171, two leveling feet 171 adjacent to each other are placed at intervals, and each of the leveling feet 171 is threadedly coupled to the frame body 110.

It can be understood that the provision of a plurality of leveling feet 171 facilitates the adjustment of the height of the sex positioning chair 100, thereby enabling the sex positioning chair 100 to be fitted to the soft furniture.

Of course, for the above-mentioned embodiment, the height adjusting member 170 may also be a telescopic tube which includes a first tube body, a second tube body, a spring and a steel ball, the first tube body is sleeved on the second tube body, the first tube body is provided with a plurality of positioning holes, and the spring is connected between the second tube body and the steel ball: when the steel ball is pressed, the steel ball can slide out of one positioning hole and snap into the adjacent other positioning hole under the elastic action of the spring, so that the length of the telescopic tube can be telescopically adjusted, and thus the height of the sex positioning chair 100 can also be adjusted.

In one embodiment, the sex positioning chair 100 further includes a third support coupled to the frame body 110 on one side of the inclined plate 120 away from the first support 130. In this way, the sex positioning chair 100 can be used without soft furniture such as the bed 200 and the sofa, i.e., the legs of the man 400 and the legs of the woman 300 can be laid on the third support when the sex positioning chair 100 is used.

In one particular embodiment, the sex positioning chair 100 includes a frame body 110, an inclined plate 120, a first support 130, a second support 140, an adjustment pin 161, and a height adjusting member 170. The frame body 110 is placed on the ground in a vertical direction, and the frame body 110 includes a first mounting plate 111, a second mounting plate 112 and a third mounting plate 113, wherein the third mounting plate 113 is connected between the first mounting plate 111 and the second mounting plate 112, and the first mounting plate 111, the second mounting plate 112 and the third mounting plate 113 together define a receiving space 114; one side of the inclined plate 120 is rotatably connected to the first mounting plate 111 and the second mounting plate 112, the other side of the inclined plate 120 is provided with a pin hole 121 in communication with the receiving space 114, the first mounting plate 111 and/or the second mounting plate 112 are provided with a plurality of adjustment holes 115, each adjustment hole 115 is in communication with the receiving space 114, an adjustment pin 161 is provided through the pin hole 121 and one of the adjustment holes 115, and the preset angle formed by the inclined plate 120 and the vertical direction is $\alpha$, and $0° \leq \alpha \leq 50°$ is satisfied; the first support 130 is connected between the first mounting plate 111 and the second mounting plate 112, the second support 140 includes a first support plate 141 and a second support plate 142, the first support plate 141 is rotatably connected to the first mounting plate 111 via a first rotating hinge 162, and the second support plate 142 is rotatably connected to the second mounting plate 112 via a second rotating hinge 163; the height adjusting member 170 includes a plurality of feet 171, two leveling feet 171 adjacent to each other are placed at intervals, and each of the leveling feet 171 is threadedly coupled to the frame body 110.

Based on the above-mentioned structure, when the sex positioning chair 100 is used, illustratively, the frame body 110 is abutted against the edge of the bed 200, the height of the sex positioning chair 100 is adjusted by means of the leveling feet 171, so that the sex positioning chair 100 is flush with the height of the bed 200, and the preset angle α of the inclined plate 120 is adjusted by means of the adjustment pin 161 and the adjustment hole 115, for example, the preset angle α is adjusted to 50°; the first support plate 141 and the second support plate 142 are opened, such that the first support plate 141 and the second support plate 142 are in a state of vertically opening the receiving space 114; the legs of the woman 300 lie horizontally on the bed 200, the upper part of the hip enters the receiving space 114 and lies down along the inclined plate 120, the arms are supported on the first support 130, and the head rests on the first support 130, so that the upper part of the hip of the woman 300 and the vertical direction are maintained at the above-mentioned preset angle; the man 400 closes the first support plate 141 and the second support plate 142, so that the first support plate 141 and the second support plate 142 are in a state of horizontally closing the receiving space 114; the man 400 lies horizontally on the woman 300 along the position of the woman 300, the legs thereof are opened on the outer sides of the legs of the woman 300 (may also be on the inner sides of the legs of the woman 300), the part below the hip of the man 400 is flush with the woman 300, and the part above the hip of the man 400 lies on the first support plate 141 and the second support plate 142 by means of the bed 200 as a support: so that the body of the man 400 is balanced and the weight does not press on the body of the woman 300 (the man 400 may not lie on the first support plate 141 and the second support plate 142, but the arm is directly supported on the first support 130 so as to keep the whole body horizontal by means of both hands); the man 400 moves from the top to the bottom, and the woman 300 moves from the bottom to the top or keeps the posture immobile, so as to achieve the intersection of the man and the woman in the above-mentioned specific posture.

In the description of this specification, reference to the description of the terms "an embodiment", "some embodiments", "an example", "particular examples", or "some examples", etc., means that a particular feature, structure, material, or characteristic described in connection with the embodiment or example is included in at least one embodiment or example of the application. In this specification, schematic representations of the above terms are not necessarily directed to the same embodiment or example. Moreover, the particular features, structures, materials, or characteristics described may be combined in any one or more embodiments or examples in a suitable manner. Furthermore, various embodiments or examples described in the description, as well as features of various embodiments or examples, may be integrated and combined by a person skilled in the art without departing from the scope of the present disclosure.

Although embodiments of the application have been shown and described above, It can be understood that the above embodiments are exemplary and not to be construed as limiting the application, and that changes, modifications, substitutions, and alterations can be made to the above embodiments by a person skilled in the art within the scope of the application.

The invention claimed is:

1. A sex positioning chair, comprising:

a frame body for being placed on the ground in a vertical direction, the frame body defining a receiving space;

an inclined plate located in the receiving space and connected to the frame body, wherein a preset angle formed by the inclined plate with respect to the vertical direction is α, and $0° \leq \alpha \leq 50°$ is satisfied;

a first support located below the inclined plate in the vertical direction and connected to the frame body; and a second support located above the inclined plate in the vertical direction and connected to the frame body, the second support being used for opening or closing the receiving space;

when the sex positioning chair is used, the frame body is abutted against an edge of an external support, the receiving space is opened by the second support, legs of a woman are laid on the external support, an upper part of a hip of the woman enters the receiving space and is laid down along the inclined plate, and arms of the woman are supported on the first support to enable the upper part of the hip of the woman is kept at the preset angle with the vertical direction, a man is laid horizontally on the woman along a posture of the woman, and an upper part of a hip of the man is laid on the second support.

2. The sex positioning chair according to claim 1, wherein $30° \leq \alpha \leq 50°$ is satisfied.

3. The sex positioning chair according to claim 1, wherein one side of the inclined plate close to the external support is rotatably connected to the frame body, and a pin hole communicating with the receiving space is provided on an other side of the inclined plate far away from the external support, the sex positioning chair further comprising an adjustment pin, and a plurality of adjustment holes are provided on the frame body at intervals, each of the adjustment holes communicating with the receiving space, and the adjustment pin is provided through the pin hole and one of the adjustment holes.

4. The sex positioning chair according to claim 1, wherein the frame body comprises a first mounting plate and a second mounting plate provided at intervals, the inclined plate is connected between the first mounting plate and the second mounting plate, the first support is connected between the first mounting plate and the second mounting plate, the second support comprises a first support plate and a second support plate, the first support plate is movably connected to the first mounting plate, and the second support plate is movably connected to the second mounting plate.

5. The sex positioning chair according to claim 4, wherein one side of the first support plate close to the first mounting plate is rotatably connected to the first mounting plate, and one side of the second support plate close to the second mounting plate is rotatably connected to the second mounting plate.

6. The sex positioning chair according to claim 5, further comprising a first rotating hinge and a second rotating hinge, wherein one side of the first rotating hinge is connected to one side of the first mounting plate facing away from the second mounting plate, the other side of the first rotating hinge is connected to one side of the first support plate facing away from the first mounting plate, one side of the second rotating hinge is connected to one side of the second mounting plate facing away from the first mounting plate, and the other side of the second rotating hinge is connected to one side of the second support plate facing away from the second mounting plate;

when the second support closes the receiving space, one side of the first support plate facing the first mounting plate comes into contact with the first mounting plate, and one side of the second support plate facing the second mounting plate comes into contact with the second mounting plate.

7. The sex positioning chair according to claim 4, wherein the frame body further comprises a third mounting plate connected between the first mounting plate and the second mounting plate, the first mounting plate, the second mounting plate, and the third mounting plate collectively defining the receiving space.

8. The sex positioning chair according to claim 1, further comprising a height adjusting member connected to a bottom portion of the frame body in the vertical direction for adjusting a distance between the frame body and the ground.

9. The sex positioning chair according to claim 8, wherein the height adjusting member comprises a plurality of leveling feet, adjacent two of the leveling feet are provided at intervals, and each of the leveling feet is screw-coupled to the frame body.

10. The sex positioning chair according to claim 1, further comprising a third support connected to the frame body on one side of the inclined plate away from the first support.

* * * * *